United States Patent [19]

Rauschen et al.

[11] 4,364,152

[45] Dec. 21, 1982

[54] WEB DIVIDING DEVICE

[75] Inventors: Rudolf Rauschen; Ludwig Schellen, both of Monchen-Gladbach, Fed. Rep. of Germany

[73] Assignee: Trützschler GmbH & Co. KG, Monchen-Gladbach, Fed. Rep. of Germany

[21] Appl. No.: 162,390

[22] Filed: Jun. 23, 1980

[30] Foreign Application Priority Data

Jun. 23, 1979 [DE] Fed. Rep. of Germany ..... 2925397

[51] Int. Cl.[3] ..... D01G 15/40; D01G 15/46

[52] U.S. Cl. ..... 19/105; 19/106 R; 19/159 R; 19/288

[58] Field of Search ..... 19/105, 106 R, 288, 19/159 R

[56] References Cited

U.S. PATENT DOCUMENTS

| | | | |
|---|---|---|---|
| 384,690 | 6/1888 | Henry et al. | 19/145.7 |
| 1,189,740 | 7/1916 | Rooney | 19/159 R |
| 2,851,849 | 9/1958 | Merrill | 57/252 |
| 3,218,676 | 11/1965 | Lenk | 19/105 |
| 3,409,945 | 11/1968 | Godwin et al. | 19/288 |
| 3,895,417 | 7/1975 | Zimmermann | 19/288 |

FOREIGN PATENT DOCUMENTS

| | | | |
|---|---|---|---|
| 508443 | 9/1930 | Fed. Rep. of Germany . | |
| 1923377 | 11/1970 | Fed. Rep. of Germany | 19/288 |
| 1760935 | 1/1972 | Fed. Rep. of Germany | 19/105 |
| 744399 | 4/1933 | France | 19/288 |
| 1179532 | 7/1957 | France . | |

*Primary Examiner*—Louis Rimrodt

*Attorney, Agent, or Firm*—Spencer & Kaye

[57] ABSTRACT

A carding machine includes a vertical tuft feed chute, a supply table on which a fiber lap discharged by the feed chute is forwarded in a direction of advance, a carding unit arranged downstream of the supply table as viewed in the direction of advance and receiving the fiber lap from the supply table and discharging a fiber web divided into side-by-side arranged web parts and a plurality of sliver forming trumpets each receiving a separate one of the web parts. There is further provided a dividing device having a vertically oriented tuft divider supported in the feed chute. The tuft divider separates the feed chute into vertically extending feed chute parts situated side-by-side as viewed in the direction of lap advance, whereby the fiber lap discharged by the feed chute is divided into side-by-side positioned fiber lap parts.

4 Claims, 6 Drawing Figures

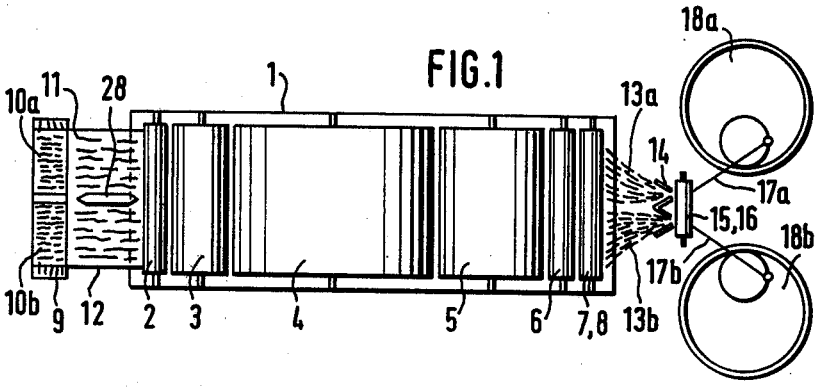
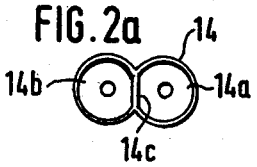
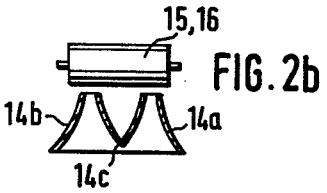
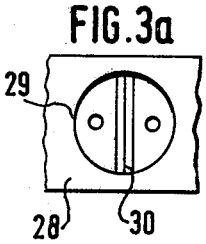
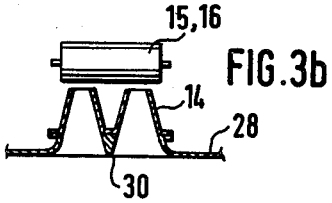
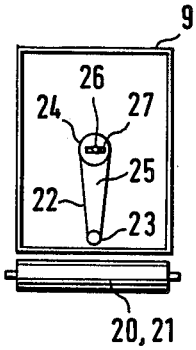
FIG.4

WEB DIVIDING DEVICE

BACKGROUND OF THE INVENTION

The present invention relates generally to an apparatus for producing a fiber web.

More particularly, the invention relates to a carding apparatus for withdrawing the fiber web in a divided manner, so that simultaneously at least two slivers may be formed by juxtapositioned sliver trumpets. In a known carding apparatus the web is divided as it issues from the squeezing rollers. Each of the two thus-obtained web parts is then admitted into a separate trumpet.

Thus, more particularly, it is known to separate the fiber material in the carding apparatus by means of a particular arrangement of the clothing of the various roller or cylinder components of the card such as the feed roller, the licker-in, the carding cylinder, the doffer or the web take-off roller. Accordingly, in order to effect a longitudinal division of the fiber web, it has been known to omit several rows of clothing teeth or to render ineffective such rows of clothing teeth by placing an adhesive substance over the tooth rows or by filling the spaces between such rows with metal or the like. U.S. Pat. No. 1,189,740 discloses a carding machine in which the fiber material (web) is divided by providing a covering strip over a narrow circumferential part of the doffer clothing. It was found in practice, however, that the covering strip has to be very firmly attached in the tooth rows of the clothing to ensure a clean separation of the fiber material, to prevent fibers from adhering to the cover strip and to ensure that the cover strip does not separate from the doffer. Thus, in case the covering strips are firmly attached to the doffer clothing to ensure all the above, the removal of the covering strips for the purpose of switching over to carding without web division is difficult because it requires substantial work input to disassemble and then again install the cover strips.

SUMMARY OF THE INVENTION

It is, accordingly, an object of the present invention to overcome the disadvantages of the prior art, and more particularly, to provide, for a division of the web, a web dividing mechanism which is separate from the rolls of the carding machine or from the clothing of such rolls.

This object and others to become apparent as the specification progresses, are accomplished by the invention, according to which, briefly stated, the carding machine includes a vertical tuft-feeding chute, a supply table on which a sheet of material discharged by the feeding chute is forwarded in a direction of advance, a dividing device for longitudinally dividing the fiber web in at least two web parts, a carding unit arranged downstream of the supply table as viewed in the direction of advance and receiving the sheet material from the supply table and discharging a divided fiber web and a plurality of sliver forming trumpets each receiving a separate one of the divided web parts. The dividing device comprises a vertically oriented tuft divider supported in the tuft chute and separating the tuft chute into vertically extending tuft chute parts situated side-by-side as viewed in the direction of material advance, whereby the material sheet discharged by the feed chute is divided into side-by-side positioned material sheet parts prior to being fed into the carding unit.

Thus, according to the invention, two or more (depending upon the number of dividers) preliminary streams of fibers are furnished via the supply table to the feed roller of the carding apparatus. Advantageously, the fiber divider is mounted so that it can be shifted laterally, i.e. transversely to the direction of fiber movement, in order to obtain a rapid adjustment of the division in the incoming quantity of fibers or any other desired division of the fiber quantity. Preferably, the upper edge (i.e. the one facing toward the inlet of the chute) of the divider is rounded, so that the fibers which are admitted from above can readily slide off this edge and do not become trapped by it. It is also advantageous to provide a fiber separator baffle on the fiber supply table between the delivery rollers of the chute and the feed roller of the card in order to prevent a recombining of the divided fiber streams which leave the delivery rollers of the fiber tuft feeding chute.

BRIEF DESCRIPTION OF THE DRAWINGS

FIG. 1 is a diagramatic top-plan view of an apparatus embodying the invention;

FIG. 2*a* is a side view illustrating two closely adjacent silver trumpets of the apparatus in FIG. 1;

FIG. 2*b* is a top-plan view illustrating the trumpets of FIG. 2*a*, together with one of the web take-off rollers;

FIG. 3*a* is a side view of a double trumpets with a web guiding baffle;

FIG. 3*b* is a top-plan view of FIG. 3*a*; and

FIG. 4 is an illustration of a tuft divider in the fiber tuft feeding chute of the apparatus.

DESCRIPTION OF PREFERRED EMBODIMENTS

FIG. 1 shows an apparatus having a carding machine 1 with a feed roller 2, a licker-in roller 3, a carding cylinder 4, a doffer 5, a web take-off roller 6 and a pair of squeezing rollers 7, 8 which are arranged one above the other and extend parallel to one another. Upstream of the carding apparatus 1, as considered in the direction of fiber movement, is the tuft feeding chute 9 of a fiber feeding arrangement from which the fiber tufts 10*a*, 10*b* are withdrawn from the lower end thereof through delivery rollers 20, 21 (compare FIG. 4) and are supplied as a lap 11 via a supplying table 12 with a lap separating baffle 28 and a not-illustrated fiber feeding table for the roller 2, to the apparatus 1.

Spaced from the squeezing rollers 7, 8 in downstream direction of fiber movement is a double trumpet 14 which is composed of two closely adjacent individual trumpets 14*a*, 14*b* which converge in the downstream direction. The material leaves the nip between the squeezing rollers 7, 8 in form of two separate gathered webs 13*a*, 13*b* each of which enters into one of the trumpets 14*a*, 14*b*, respectively. Arranged downstream of the double trumpet 14 is a pair of calender rollers 15, 16 (only the upper one is visible and desigated with reference numeral 15) which withdraw the sliver 17*a*, 17*b* from the trumpets 14*a*, 14*b* of the double trumpet 14. Also arranged downstream of the rollers 15, 16 are two cans 18*a*, 18*b* into which the slivers 17*a*, 17*b* are coiled.

The double trumpet 14 is shown in more detail in FIGS. 2*a* and 2*b* and will be seen to be composed of the two individual trumpets 14*a* and 14*b*, the circumferential walls of which interpenetrate or intersect one another, so that an inlet edge 14c is obtained which keeps the two incoming gathered web separate.

FIG. 3a illustrates a web guide baffle 28a having an opening 29, and according to FIG. 3b this is followed by a double trumpet 14 (similar to the one shown in FIGS. 2a and 2b) and by the calender rollers 15, 16. The double trumpet 14 in is FIGS. 3a and 3b is connected with the web guide baffle 28. A separating edge 30 is provided in the opening 29 to maintain the gathered web portions separate from one another.

FIG. 4 illustrates the fiber tuft feeding or inlet chute 9 with the two juxtaposed delivery rollers 20, 21 (of which only the roller 20 is visible) located at its other end so that they can withdraw fiber lap from this other end. Arranged in the lower end of the chute 9 is a tuft separator 22 which in the illustrated embodiment is composed of a lower tube 23 and a tube 24 which are connected with one another via a common sheet metal member 25, for example by welding. The lower tube 23 is stationarily mounted but can be turned about its longitudinal axis, being secured to the side walls of the chute 9. The upper tube 24 is mounted so that it can laterally shifted. For this purpose, the end faces of the upper tube 24 are each provided with a mounting member 26, such as bolts, screws or the like, which extend through respective longitudinal slots 27 formed in the side walls of the chute 9. Thus, depending upon how the divider 22 is adjusted, the two tuft streams into which it divides the incoming fiber or clumps of fibers column, can be made uniform or one can be made wider than the other. It is thus seen that the divider, for the purpose of providing two separated tuft columns, separates the inside of the tuft feeding chute into two vertical chute portions which are situated side-by-side relative to the direction of advance of the material sheet (tuft lap) on the supplying table 12.

The invention has hereinbefore been described with reference to a carding machine, but it is to be understood that this is exemplary only and that the invention has other applications, including modifications of the illustrative embodiment, all of which are intended to be encompassed within the scope of the appended claims.

We claim:

1. In a carding machine including a vertical tuft feed chute, a supply table on which a fiber lap discharged by the feed chute is forwarded in a direction of advance, a carding unit arranged downstream of said supply table as viewed in the direction of advance and receiving said fiber lap from said supply table and discharging a fiber web divided into side-by-side arranged web parts and a plurality of sliver forming trumpets each receiving a separate one of said web parts, the improvement comprising a dividing device having a vertically oriented tuft divider supported in said feed chute, said tuft divider separating said feed chute into vertically extending feed chute parts situated side-by-side as viewed in said direction of advance, whereby said fiber lap discharged by said feed chute is divided into side-by-side positioned fiber lap parts.

2. The improvement of claim 1, wherein said tuft divider is laterally shiftable in and with reference to said chute.

3. The improvement of claim 1, wherein said tuft divider having a rounded upper edge.

4. The improvement of claim 1, and further comprising a lap separating guide baffle on said supply table.

* * * * *